US007029354B1

(12) United States Patent
Griffin

(10) Patent No.: US 7,029,354 B1
(45) Date of Patent: Apr. 18, 2006

(54) COMPACT PERSONAL INFLATABLE FLOTATION DEVICE

(76) Inventor: John Griffin, 4800 Bayview Dr., Unit 502, Fort Lauderdale, FL (US) 33308

( * ) Notice: Subject to any disclaimer, the term of this patent is extended or adjusted under 35 U.S.C. 154(b) by 0 days.

(21) Appl. No.: 11/150,086

(22) Filed: Jun. 13, 2005

(51) Int. Cl.
*B63C 9/125* (2006.01)

(52) U.S. Cl. ..... 441/92; 441/96

(58) Field of Classification Search ..... 441/90, 441/92, 96, 99; 222/5
See application file for complete search history.

(56) References Cited

U.S. PATENT DOCUMENTS 3,997,079 A * 12/1976 Niemann ..... 222/5
4,627,823 A * 12/1986 Mackal ..... 441/95
5,098,325 A 3/1992 Kim et al.
5,520,485 A * 5/1996 Hermansen ..... 405/186
6,206,894 B1 * 3/2001 Thompson et al. ..... 606/144
6,722,819 B1 * 4/2004 Godoy ..... 405/186

* cited by examiner

*Primary Examiner*—Stephen Avila
(74) *Attorney, Agent, or Firm*—Crossley Patent Law; Mark Crossley

(57) ABSTRACT

A compact personal inflatable flotation device comprising a cylindrical canister, an inflatable bladder attached to the first end of the canister, the bladder of sufficient size to provide flotation support for a user, a compressed gas cartridge removably housed within the canister, a user strap attached to the canister, a bi-directional activation mechanism with a control button disposed on the outer surface of the canister, whereby the bi-directional activation control button must be moved sequentially in the Y plane then the X plane to allow the compressed gas cartridge to fill the bladder.

18 Claims, 4 Drawing Sheets

22
10
14
23
24
26
Y
52
X
50

17
40
12
5
43
37
48
19
44
36
32
20
17

COMPACT PERSONAL INFLATABLE FLOTATION DEVICE

BACKGROUND OF THE INVENTION

Flotation devices that are bulky are not often likely to be worn by those enjoying the water, whether in lakes, rivers, oceans, or even large pools and the like. Inflatable devices are therefore more likely to be kept on or near a user. Concerns with inflatable devices include size, user attachment, flotation capabilities, rapid filling, and protection against unintentional inflation. Desired inflation, though, must be convenient, easily understood, and quickly accomplished. Such a device should save countless users against drownings which occur every year. The present invention satisfies the needs and concerns for such a lifesaving device.

FIELD OF THE INVENTION

The present invention relates to flotation devices and more specifically to a compact personal inflatable flotation device.

SUMMARY OF THE INVENTION

The general purpose of the compact personal inflatable flotation device, described subsequently in greater detail, is to provide a compact personal inflatable flotation device which has many novel features that result in an improved compact personal inflatable flotation device which is not anticipated, rendered obvious, suggested, or even implied by prior art, either alone or in combination thereof.

To accomplish this, the invention comprises a canister attached to an inflatable bladder. The bladder and canister are extremely compact. The bladder is selectively inflated by a gas cartridge contained within the canister. The gas cartridge is typical of those about 2–3 inches long. The gas cartridge is, in various examples, filled with CO2, Nitrogen, and the like. The bladder is disposed on one end of the canister. The cap is threadably attached to the other end of the canister. The threaded cap provides secure but easy access to the cartridge within the canister. The loop strap is attached to the cap. The loop strap is offered in various lengths to accommodate a user wearing the strap as chosen. The loop strap is further provided in various attachment forms which include clips, ties, and the like, to further convenience users. The design of the canister with the incorporated canister chamber provides for flotation for further convenience.

The bi-directional activation mechanism of the invention provides for easy recognition and engagement of the flotation inflation. At the same time, the bi-directional activation mechanism prevents unintended activation of flotation, a key feature.

The gas cartridge activation of the inflation device provides for virtually instant inflation. The size, convenience, lack of interference in water activities, versatile attachment, and mistake proof activation of the device are unique in the art. A further feature of considerable importance is the optional global positioning satellite (GPS) transmitter. A person far from shore or a person in rough waters could be found by this device, when finding them might otherwise be difficult or impossible.

Thus has been broadly outlined the more important features of the compact personal inflatable flotation device so that the detailed description thereof that follows may be better understood and in order that the present contribution to the art may be better appreciated.

Numerous objects, features and advantages of the compact personal inflatable flotation device will be readily apparent to those of ordinary skill in the art upon reading the following detailed description of presently preferred, but nonetheless illustrative, examples of the compact personal inflatable flotation device when taken in conjunction with the accompanying drawings. In this respect, before explaining the current examples of the compact personal inflatable flotation device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the compact personal inflatable flotation device. It is therefore important that the claims be regarded as including such equivalent constructions insofar as they do not depart from the spirit and scope of the present invention.

Objects of the compact personal inflatable flotation device, along with various novel features that characterize the invention are particularly pointed out in the claims forming a part of this disclosure. For better understanding of the compact personal inflatable flotation device, its operating advantages and specific objects attained by its uses, refer to the accompanying drawings and description.

DETAILED DESCRIPTION OF THE DRAWINGS

With reference now to the drawings, and in particular FIGS. 1 through 5 thereof, example of the compact personal inflatable flotation device employing the principles and concepts of the present invention and generally designated by the reference number 10 will be described.

Figure 1:
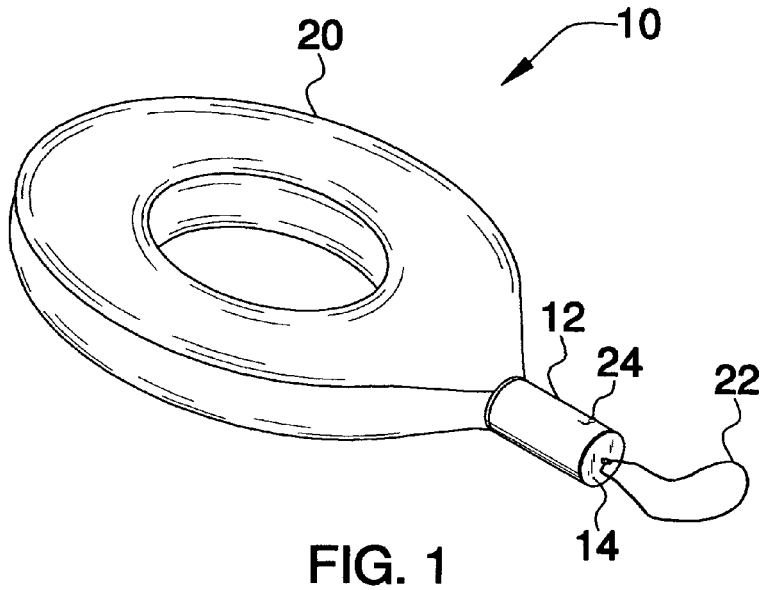
FIG. 1 is a perspective view of the invention in the inflated state.

Referring to FIG. 1, the inflated bladder 20 state of the invention 10 comprises the canister 12 attached to a side of the open-centered oval of the bladder 20. The bladder 20 is disposed on the first end of the canister 12. The cap 14 is threadably (not shown) attached to the canister 12. The loop strap 22 is attached to the cap 14.

Figure 2:
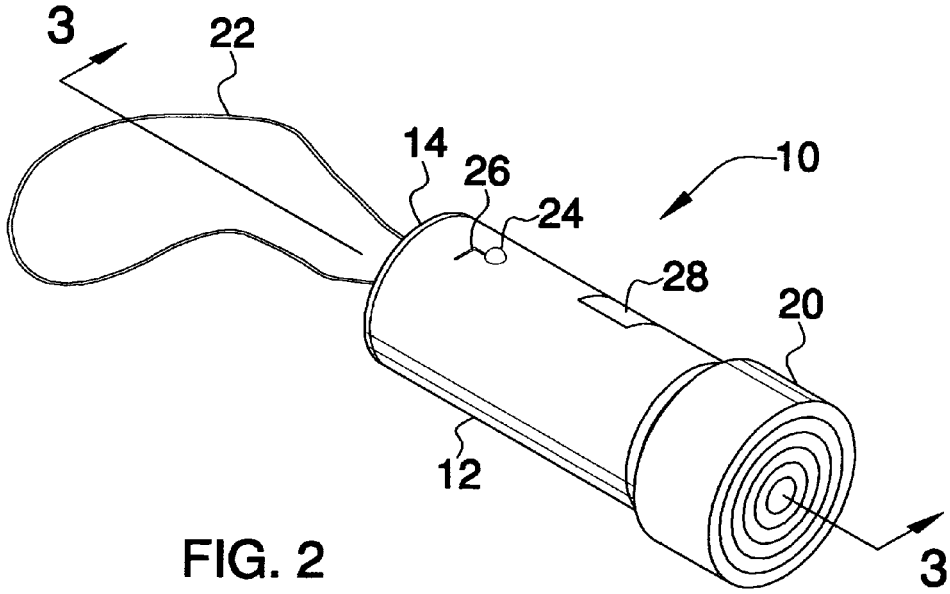
FIG. 2 is a perspective view of the invention in the deflated, un-activated state.

Referring to FIG. 2, the invention 10 is in the un-activated state. The slide button 24 is in the Y plane 52 of the slide slot 26. The bladder 20 is deflated.

Figure 3:
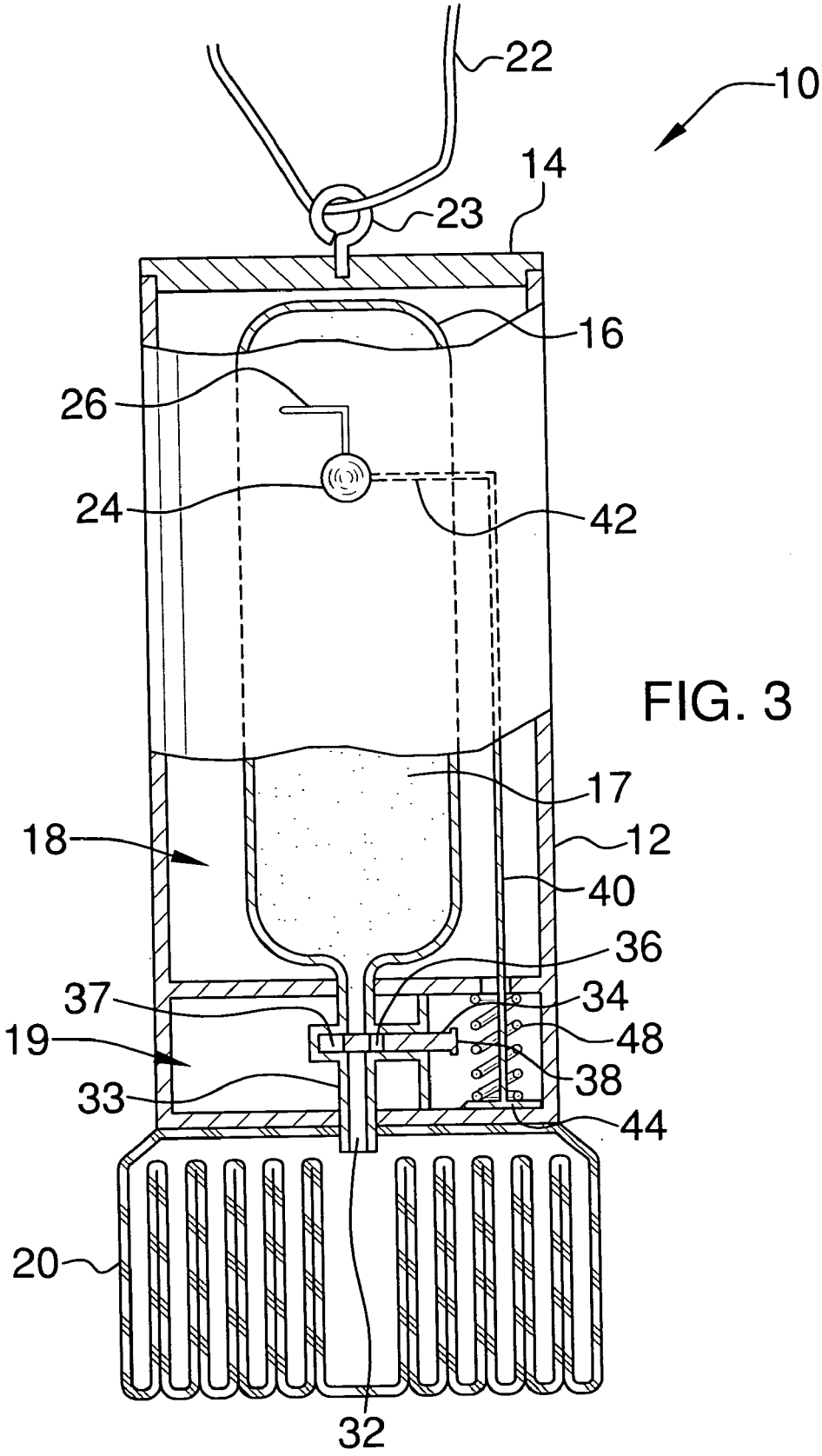
FIG. 3 is a cross-sectional view of the invention in FIG. 2.
Figure 4:
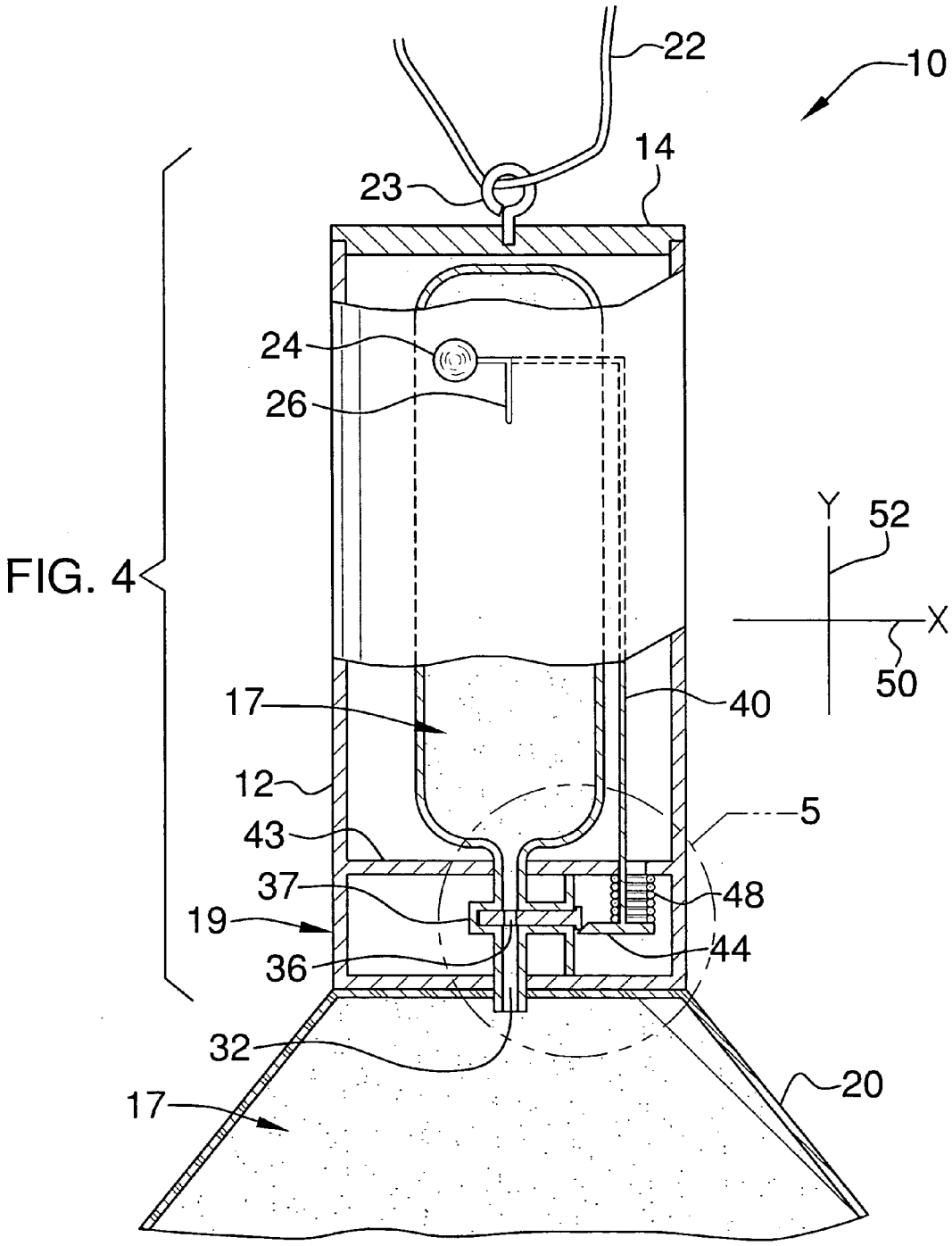
FIG. 4 is a cross-sectional view of the invention in the activated state.
Figure 5:
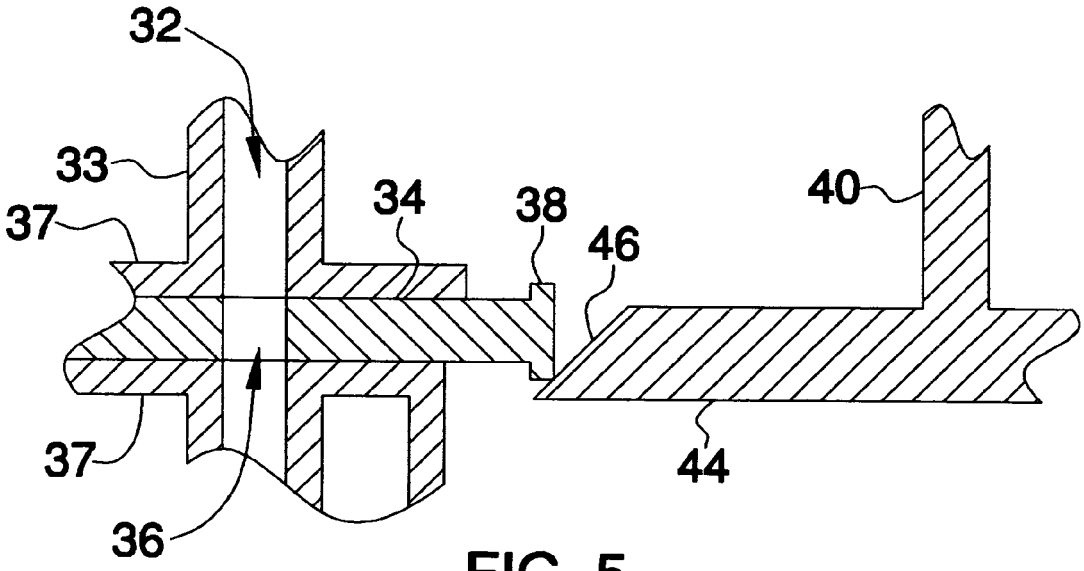
FIG. 5 is a cross-sectional view of the engagement of the activation arm with the pin head of the slide pin, the pin bore aligned with the gas passage of the neck of the cartridge.

Referring to FIGS. 3, 4 and 5, the cylindrical canister 12 has a first end, a second end, a length in the Y plane, and a width in the X plane. The canister 12 is capped on the second end by cap 14. Cap 14 is threadably received (not shown) by the canister 12. The eyelet 23 is affixed within the cap 14. The eyelet 23 connects the loop strap 22 to the canister cap 14. The canister cap 14 provides for access to and replacement of the cartridge 16.

The cartridge 16 contains compressed gas 17. The cartridge 16 is contained within the cartridge chamber 18 within the canister 12. The chamber wall 43 within the canister separates the cartridge chamber 18 from the control chamber 19. The chamber wall 43 is disposed proximal to the first end of the canister 12. The inflatable bladder 20 is attached to the first end of the canister 12. The bladder 20 is of sufficient size to provide flotation support for a user (not shown). The compressed gas cartridge 16 is removably housed within the cartridge chamber 18. The cartridge 16 has a top and a bottom. The neck 33 is disposed on the bottom of the cartridge 16. The neck 33 has a length passing through the control chamber 19 and into the bladder 20. A pin bushing 37 is within the neck 33. The bushing 37 is disposed perpendicularly to the neck 33. The gas passage 32 is within the neck 33. The gas passage 32 provides for the selective passage of compressed gas 17 from the cartridge 16 into the bladder 20. The removable cap 14 is attached to the second end of the canister 12. The passage of compressed gas 17 into the bladder 20 is selectively controlled by the bi-directional activation mechanism. The mechanism comprises a slide slot 26 within the canister 12. The slide slot 26 is proximal to the second end of the canister 12. The slide slot 26 is disposed in the Y plane 52 and the X plane 50. The slide button 24 is slideably disposed within the slide slot 26. A rod right angle 42 is affixed to the slide button 24. The rod right angle 42 is disposed within the canister 12. An activation rod 40 is attached to the rod right angle 42. The activation rod 40 is within the length of the canister 12. The activation rod 40 passes through the cartridge chamber 18 into the control chamber 19.

An activation arm 44 is perpendicularly attached to an end of the activation rod 40. The activation arm 44 within the control chamber 19. A beveled arm face 46 is on the activation arm 44 and faces medially within the control chamber 19. A compression spring 48 is disposed within the control chamber 19. The compression spring 48 acts upon the chamber wall 43 and the activation arm 44. A slide pin 34 is disposed within the pin bushing 37. A pin bore 36 is within the slide pin 34. The pin bore 36 is selectively aligned with the gas passage 32 of the neck 33 of the gas cartridge 16. The pin head 38 is disposed laterally on the slide pin 34. The pin head 38 is disposed proximal to the beveled arm face 46 of the activation arm 44.

Referring to FIG. 3, the slide button 24 is disposed in the slide slot 26 such that the activation arm 44 does not engage the pin head 38. The bladder 20 is deflated.

Referring to FIGS. 4 and 5, the slide button 24 has been moved first in the Y plane 52, then in the X plane 50. The spring 48 pressure has been overcome. The activation arm 44 has moved to engage the pin head 38. The slide pin 34 has been moved medially within the pin bushing 37. The pin bore 36 has been aligned with the gas passage 32. Compressed gas 17 has thereby flowed from the gas cartridge 16 to inflate the bladder 20.

With respect to the above description then, it is to be realized that the optimum dimensional relationships for the parts of the compact personal inflatable flotation device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A compact personal inflatable flotation device, the device comprising:

a cylindrical canister, the canister having a first end and a second end;

an inflatable bladder attached to the first end of the canister, the bladder of sufficient size to provide flotation support for a user;

a compressed gas cartridge removably housed within the canister, the cartridge having a top and a bottom, the bottom facing the first end of the canister;

a removable cap attached to the second end of the canister, the removable cap for accessing the cartridge;

a strap attached to the cap, the strap for securing to the user;

a bi-directional activation mechanism, the mechanism control button disposed on the outer surface of the canister, whereby the bi-directional activation control button must be moved sequentially in the Y plane then the X plane to allow the compressed gas cartridge to fill the bladder, thereby providing flotation support for the user.

2. The invention in claim 1 wherein the bladder is an open centered oval.

3. The invention in claim 2 wherein a side of the oval is attached to the canister.

4. The invention in claim 3 wherein the compressed gas is CO2.

5. The invention in claim 3 wherein the compressed gas is nitrogen.

6. The invention in claim 4 wherein the cap of the canister is threadably removable.

7. The invention in claim 5 wherein the cap of the canister is threadably removable.

8. The invention in claim 6 wherein the canister is further comprised of a global positioning satellite transmitter.

9. The invention in claim 7 wherein the canister is further comprised of a global positioning satellite transmitter.

10. A compact personal inflatable flotation device, the device comprising:

a cylindrical canister, the canister having a first end and a second end, a length in the Y plane and a width in the X plane;

a cartridge chamber within the canister;

a chamber wall within the canister, the chamber wall disposed proximal to the first end of the canister;

a control chamber within the first end of the canister, the control chamber divided from the cartridge chamber by the chamber wall;

an inflatable bladder attached to the first end of the canister, the bladder of sufficient size to provide flotation support for a user;

a compressed gas cartridge removably housed within the cartridge chamber, the cartridge having a top and a bottom;

a neck on the bottom of the gas cartridge, the neck having a length passing through the control chamber and into the bladder;

a pin bushing within the neck, the bushing disposed perpendicularly to the neck;

a gas passage within the neck, the gas passage providing for the selective passage of compressed gas from the cartridge into the bladder;

a removable cap attached to the second end of the canister, the removable cap for accessing the cartridge;

a strap attached to the cap, the strap for securing to the user;

a bi-directional activation mechanism, the mechanism comprising:

a slide slot within the canister, the slide slot proximal to the second end of the canister, the slide slot disposed in the Y plane and the X plane;

a slide button slideably disposed within the slide slot;

a rod right angle affixed to the slide button, the rod right angle disposed within the canister;

an activation rod attached to the rod right angle, the activation rod within the length of the canister, the activation rod passing through the cartridge chamber into the control chamber;

an activation arm perpendicularly attached to an end of the activation rod, the activation arm within the control chamber;

a beveled arm face on the activation arm;

a compression spring within the control chamber, the compression spring acting upon the chamber wall and the activation arm;

a slide pin disposed within the pin bushing;

a pin bore within the slide pin, the pin bore selectively aligned with the gas passage of the neck of the gas cartridge;

a pin head on the slide pin, the pin head disposed proximal to the beveled arm face of the activation arm, whereby the user slides the slide button in the Y plane then the X plane of the slide slot, thereby overcoming the spring tension, whereby the beveled arm face moves the pin head, thereby sliding the slide pin such that the pin bore aligns with the gas passage, the compressed gas thereby flowing from the gas cartridge to inflate the bladder.

11. The invention in claim 10 wherein the bladder is an open centered oval.

12. The invention in claim 11 wherein a side of the oval is attached to the canister.

13. The invention in claim 12 wherein the compressed gas is CO2.

14. The invention in claim 12 wherein the compressed gas is nitrogen.

15. The invention in claim 13 wherein the cap of the canister is threadably removable.

16. The invention in claim 14 wherein the cap of the canister is threadably removable.

17. The invention in claim 16 wherein the canister is further comprised of a global positioning satellite transmitter.

18. The invention in claim 17 wherein the canister is further comprised of a global positioning satellite transmitter.

* * * * *